United States Patent [19]

Leonard et al.

[11] 4,266,930

[45] May 12, 1981

[54] GAS COLLECTOR/SPARK IGNITER FOR GAS BURNERS

[75] Inventors: Murray Leonard, Mayfield; Herbert F. Jugl, Bedford, both of Ohio

[73] Assignee: Vernitron Corporation, Bedford, Ohio

[21] Appl. No.: 941,281

[22] Filed: Sep. 11, 1978

[51] Int. Cl.[3] ..... F23Q 7/06

[52] U.S. Cl. ..... 431/263; 126/41 R; 431/264

[58] Field of Search ..... 126/41 R; 431/263, 264, 431/191, 193

[56] References Cited

U.S. PATENT DOCUMENTS

| | | | |
|---|---|---|---|
| 1,273,467 | 7/1918 | Doble et al. | 431/263 |
| 3,592,179 | 7/1971 | Hahn | 431/263 |
| 4,035,136 | 7/1977 | Howatt et al. | 431/264 |
| 4,188,937 | 2/1980 | Baynes | 431/263 |

FOREIGN PATENT DOCUMENTS

| | | |
|---|---|---|
| 526144 | 9/1940 | United Kingdom . |
| 667394 | 2/1952 | United Kingdom . |
| 704373 | 2/1954 | United Kingdom . |
| 1210838 | 11/1970 | United Kingdom . |

*Primary Examiner*—Carroll B. Dority, Jr.
*Attorney, Agent, or Firm*—Edward E. Sachs

[57] ABSTRACT

A spark igniter for gas burners includes a gas collector having a passage extending between open front and rear ends. The open front end is substantially larger than the open rear end, and is positionable adjacent a gas burner for receiving gas therefrom. Gas flows into the open front end of the collector and mixes with air to form a combustible mixture. A spark igniter mounted within the gas collector passage ignites the mixture to produce a flame for igniting the gas burner. The gas collector is metal and forms the ground electrode for the spark igniter, and has an integral mounting bracket thereon.

5 Claims, 4 Drawing Figures

GAS COLLECTOR/SPARK IGNITER FOR GAS BURNERS

The invention relates generally to spark igniters for gas burners and, more particularly, to piezoelectric igniters for gas burners.

Conventional spark igniters for gas burners include a flash tube having electrodes associated therewith. The flash tube is positioned adjacent a gas burner for receiving gas which mixes with air to form a combustible mixture in the flash tube. Creation of a spark across the electrodes ignites the mixture in the flask tube to produce a flame for igniting the gas burner. In arrangement of the type described, the flash tube has a relatively small front opening for receiving gas from the burner. If the flash tube is mounted out of alignment with a burner orifice, a substantial amount of gas finds its way into the flash tube for ignition. Even with the flash tube mounted in direct alignment with the burner orifice, problems sometimes occur due to the turbulence created by the gas flowing directly into the flash tube and this sometimes prevents good combustion or snuffs out the flame before the burner ignites.

For certain applications, such as gas grills, spark igniters frequently become fouled by food droppings because the electrodes are exposed to contamination.

It is therefore the primary object of the present invention to provide an improved spark igniter for gas burners wherein the igniter includes an improved gas collector.

It is a further object of the invention to provide an improved piezoelectric igniter having a protected electrode.

It is an additional object of the invention to provide an improved spark igniter having a gas collector which is very economical to manufacture and assemble.

It is also an object of the invention to provide a spark igniter having a gas collector wherein turbulence is minimized.

An aspect of the present invention resides in a gas collector having a passage extending between open front and rear ends. The gas collector is positioned with its open front end closely adjacent a gas burner for receiving gas from the burner. The open rear end of the gas collector allows flow of gas completely therethrough to prevent a buildup of insulating gas around the electrode mounted within the gas collector passage.

The gas collector is fabricated from metal, such as sheet stainless steel, and provides protection for the electrode positioned within the passage. The passage has a large passage portion extending from the open front end to a transition point located intermediate the front and rear ends. A smaller passage portion extends from the transition point to the open rear end. The spark igniter is positioned within the small passage portion where laminar flow occurs. The large passage portion may converge gradually toward the transition point or may abruptly merge into the small diameter passage portion.

Inwardly extending lips are provided around a major portion of the open front end for helping to retain gas within the gas collector. In a conventional flash tube, the swirling action of the gas sometimes sweeps the gas out of the tube shortly after it enters. With the lips around at least a major portion of the open front end, the lips help to prevent gas from being swept out. An extended lower lip accommodates variation in burner orifice angles observed between manufacturers of burners.

The bottom of the gas collector has an integral mounting flange for mounting the gas collector in position adjacent a gas burner. Alternate mounting methods employing threaded sections, brackets, standoffs, etc., commonly used in the art may be used. The collector may be mounted in any desirable location, including the front, rear, center or as convenient to burner and housing construction.

For a better understanding of the present invention, together with other and further objects thereof, reference is had to the following description taken in connection with the accompanying drawings, and its scope will be pointed out in the appended claims.

Figure 1:
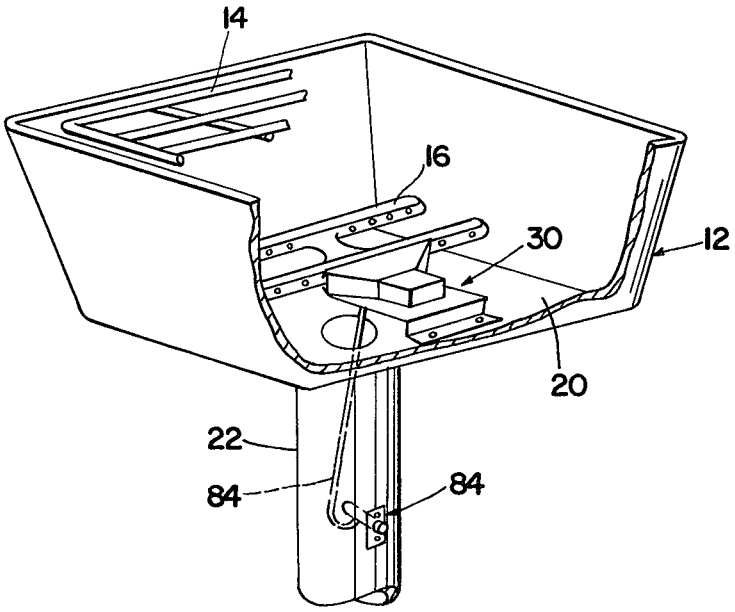
FIG. 1 is a partial perspective illustration of a gas grill having the improvements of the present application incorporated therein, and with portions cut away for clarity of illustration.

Referring now to the drawing, and particularly FIG. 1, a gas grill includes a dished bottom housing 12 to which a hinged lid is normally connected in a known manner. A food supporting rack 14 is mounted on the housing 12 above a layer of rock or briquettes beneath which a gas burner 16 is positioned for heating same.

The gas burner 16 is mounted adjacent the bottom wall 20 of the housing 12 and is supplied with gas from a supply conduit extending through hollow vertical post 22 on which the housing 12 and the burner 16 are supported. A selectively operable control valve is provided in a known manner for controlling flow of gas to the burner 16.

The gas collector 30 forms part of a spark igniter and is manufactured from sheet stainless steel. A lower portion 32 includes a flat plate portion 34 having an upwardly turned lip **36*a* or 36*b* along the front end thereof. The opposite end portion of the lower gas collector portion 32 extends downwardly at 38 and then terminates in a generally horizontal mounting flange 40 extending generally parallel to the plate portion 34 and spaced therebelow. Other mounting methods, generally known, may be used for mounting. Suitable holes as at 42 are provided in the mounting flange 40 for receiving fasteners to secure the flange 40 to the bottom wall 20 of the housing 12. An upper portion 44 of the gas collector 30 has a downwardly extending lip 46 appropriately positioned, with reference to the lip 36*a* or 36*b*. The upper portion 44 has a flat upper plate portion 48 which is spaced vertically above the lower plate portion 34. Opposite sides 50 on the upper portion 44 converge from the lip 46 toward a transition point generally indicated at 52, and then extend straight back parallel to one another as at 54. The gas collector need not be necessarily symmetrical about the axis 3—3**.

Figure 3:
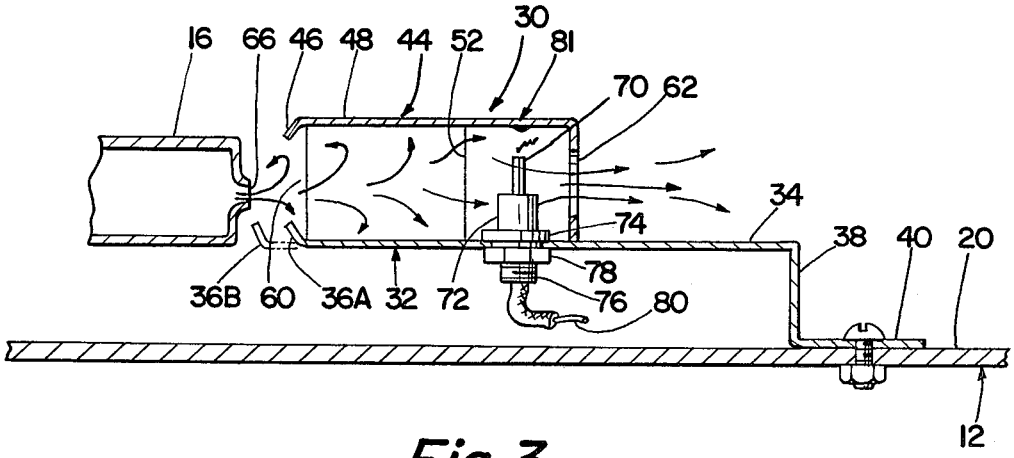
FIG. 3 is a cross-sectional elevational view taken generally on line 3—3 of FIG. 2.

The free terminal edges of the sides 50, 54 are suitably secured to the lower plate portion 34 as by welding, the use of fasteners or by providing tabs which extend through slits or holes in the lower plate portion 34. Outwardly extending mounting flanges may be provided on the sides 50, 54 if so desired. The upper and lower portions 32, 44 cooperate to define an elongated passage which extends between open front and rear ends 60 and 62. The open front end 60 is bounded across the top and bottom of its periphery by the lips 36*a* or 36*b*, 46 which help to retain gas within the collector 30. The front open end 60 is substantially larger than the open rear end 62. The open front end 60 has a width substantially greater than the height thereof. The width of the front open end 60 is preferably greater than two times the height thereof. The width is also such that with the gas collector 30 mounted as shown in FIG. 3 with the open front end 60 positioned closely adjacent the gas burner 16, a plurality of the horizontally-spaced burner orifices 66 will be aligned for direct communication with the open front end 60.

When the burner 16 is turned on, gas will flow from the burner orifices 66 through the open front end 60 to the interior of the gas collector 30. The flow is somewhat turbulent as indicated by the arrows in FIG. 3. The flowing gas also draws air through the open front end 60 and the initial turbulent flow provides good mixing to produce a good combustible mixture. The lips 36*a*, 36*b* 46 help to prevent the gas or mixture from being swept back out the front opening 60. At the transition point 52, the flow becomes more laminar toward the open rear end 62. The open rear end 62 prevents a buildup of insulating gas within the gas collector. Its predetermined size controls the flow rate of gas-air in the vicinity of the ignition point.

The passage through the gas collector 30 includes a large front passage portion extending from the open front end 60 to the transition point 52, and a small passage portion extending from the transition point 52 to the open rear end 62. An electrode 70 is mounted within the small passage portion as shown in FIG. 3. A ceramic insulator 72 has a circumferential flange 74 bearing against the upper surface of the lower flat plate portion 34 around a hole therethrough, and has a threaded extension passing through the hole as at 76. The threaded portion may be extended through the housing for mounting purposes and protection of the high voltage lead 80 from the heat within the enclosure. A nut 78 on the threaded portion 76 bears against the underside of the lower plate portion 34 in opposition to the flange 74. The electrode 70 is suitably secured within the ceramic insulator 72 and a wire 80 mounted within a sheath of heat resistant material extends to a piezoelectric voltage source 84 shown mounted in the post 22 of FIG. 1.

The piezoelectric voltage source 84 may be of any suitable type which produces a voltage when a piezoelectric crystal is mechanically stressed by pushing a button or the like. The voltage source may include the type disclosed in U.S. Pat. Nos. 3,449,637 issued June 10, 1969, to Suzuki, or 3,469,119 issued Sept. 23, 1969, to Parkinson.

The upper end of the electrode 70 is spaced below the upper plate portion 48 to define a spark gap therewith. A dimple generally indicated at 81 on the upper plate 48 helps define the spark gap path. Operation of the piezoelectric voltage source 84 will cause a spark to jump between the electrode 70 and the inside surface of the plate portion 48 on the gas collector 30 at or near 81. This spark will ignite the combustible mixture within the small passage portion and the flame will shoot out the front open end 60 of the collector 30 to ignite the burner 16.

Figure 2:
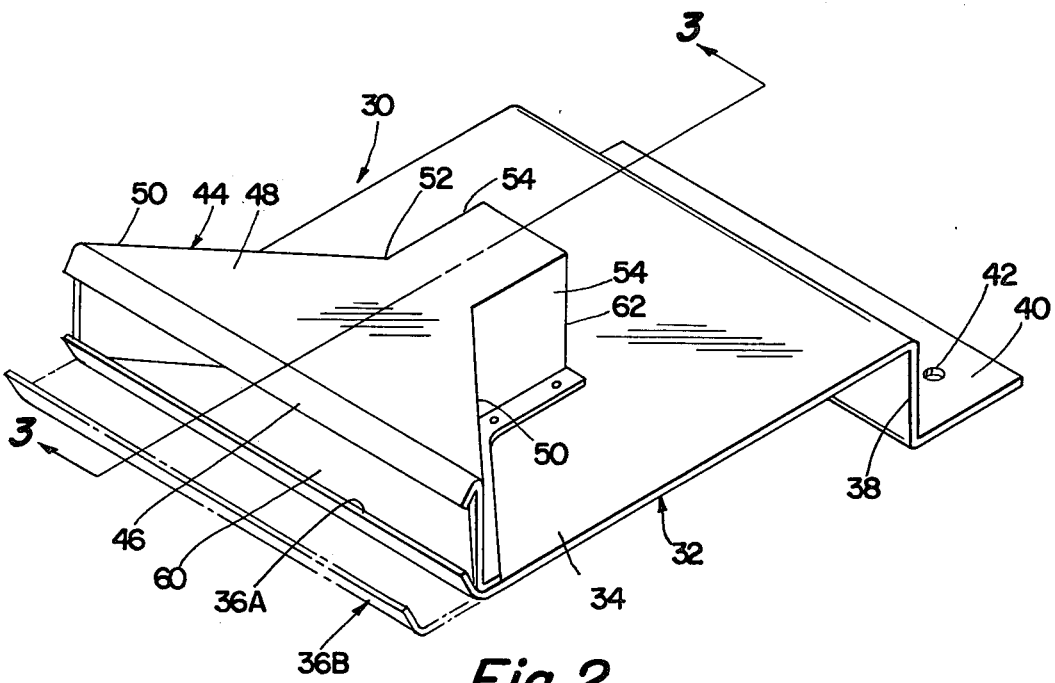
FIG. 2 is a perspective illustration of an improved gas collector constructed in accordance with the present application and showing the extended lower lip in phantom.

The electrode 70 is protected from food droppings and the like falling from food supported on the rack 14 because the electrode 70 is completely within the gas collector 30. That is, a roof is provided between the electrode and the food supporting rack. In the arrangement shown in FIGS. 2 and 3, the large passage portion gradually converges from the open front end 60 to the transition point 52. The small passage portion is then of substantially uniform cross-sectional size from the transition point 52 to the open rear end 62.

Figure 4:
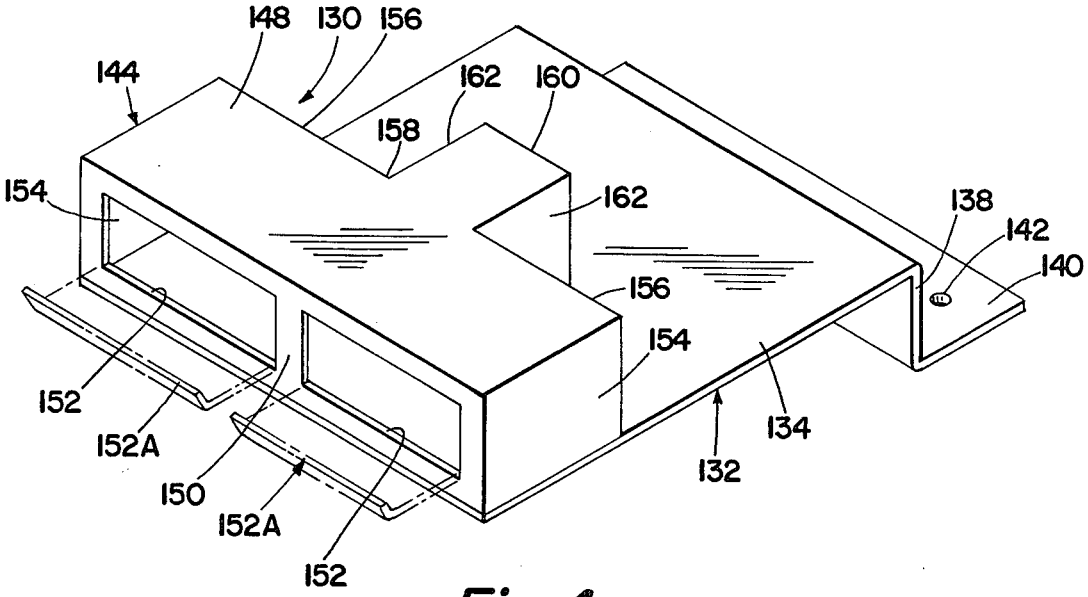
FIG. 4 is a perspective illustration of another form of gas collector.

FIG. 4 shows another arrangement wherein a gas collector 130 has a lower portion 132 including a lower flat plate portion 134 having a downwardly extending leg 138 at one end portion thereof merging into a horizontally extending mounting flange 140 having suitable holes 142 therethrough for receiving fasteners to mount same to the bottom wall 20 of the housing 12. An upper collector portion 144 is suitably secured to the lower plate portion 134 as by welding, the use of fasteners or by providing tabs which extend through slits. The upper portion 144 has an upper flat plate portion 148, and all of the depending portions are bent downwardly therefrom. A front member 150 bent downwardly from upper flat plate portion 148 has openings 152 formed inwardly from the outer periphery thereof to provide inwardly extending lips around the front opening. Alternatively, lower lips 152*a* may be provided extending axially outwardly from the openings. Opposite sides 154 are bent downwardly from the upper flat plate portion 148 as are rear portions generally indicated at 156. A transition point generally indicated at 158 provides a substantially smaller passage portion extending therefrom to the open rear end 160. Opposite smaller sides 162 are bent downwardly from the upper plate portion 148 and extend from the transition point 158 to the open rear end 160.

In the arrangement of FIG. 4, the large passage portion extending from the open front end 152 to the transition point 158 abruptly merges into the small passage portion extending from the transition point to the open rear end 160. An electrode is mounted within the collector passage between the transition point 158 and the open rear end 160 in the same manner as described with reference to FIG. 3. In other respects, the gas collector of FIG. 4 operates in essentially the same manner as the gas collector of FIGS. 1–3.

In the arrangements shown and described, the lower portion 134, 34 of the gas collector also provides an integral mounting means in the form of a mounting bracket for mounting the gas collector in proper position adjacent a gas burner for receiving gas therefrom through the large open front end. It will be appreciated that other brackets, fixtures, threaded sections, generally known may be used for mounting.

It is possible to position a baffle or deflector within the collector passage at the transition point 52, 158 for helping to change the tubulent flow to laminar flow. Such a baffle or deflector could also be in the form of a plurality of louvers.

The gas collector of the present application is capable of igniting either or both burners of a dual burner grill by positioning the collector for receiving gas from both burners. The collector may be centrally mounted between the juncture of the dual burners for receiving gas from both burners. The wide collector openings will receive gas from either burner and efficiently ignite same. The collector is capable of igniting dual burners independently or simultaneously.

While there have been described what are at present considered to be the preferred embodiments of this invention, it will be obvious to those skilled in the art that various changes and modifications may be made therein without departing from the invention, and it is aimed, therefore, in the appended claims to cover all such changes and modifications which fall within the true spirit and scope of the invention.

What is claimed is:

1. A spark igniter for gas burners comprising: a gas collector made of metal and having a passage between open front and rear ends, said front end havin a substantially larger opening than said rear end, said passage having a large passage portion from said front end to a transition point intermediate said front and rear ends and having a substantially smaller passage portion from said transition point to said rear end, said gas collector having top and bottom walls, electrode means mounted on said bottom wall and extending upwardly therethrough, said electrode means having an electrode tip positioned within said small passage portion in closely spaced relationship to said top wall and defining a spark gas therewith for providing a spark and igniting a combustible mixture flowing through said smaller passage portion, and lips extending inwardly around at least a portion of said open front end.

2. A spark igniter for gas burners comprising: a gas collector having a passage between open front and rear ends, said front end having an opening substantially larger than the opening in said rear end, said collector being made of sheet stainless steel and having substantially flat top and bottom walls and sidewalls, an electrode mounted on said bottom wall and extending upwardly therethrough intermediate said front and rear ends, said electrode havin an electrode tip positioned within said passage closely adjacent said top wall to define a spark gap therewith, and said front end having inwardly extending lips around at least a portion thereof.

3. The igniter of claim 2 wherein said passage has a large passage portion from said front end to a transition point intermediate said front and rear ends and has a substantially smaller passage portion from said transition point to said rear end, and said electrode being mounted to said bottom wall intermediate said transition point and said rear end.

4. A spark igniter for gas burners comprising: a gas collector of sheet metal including a passage between open front and rear ends respectively having front and rear openings, said collector having spaced substantially flat and parallel top and bottom walls, said collector having sidewalls extending between said top and bottom walls from said front end to said rear end, said sidewalls being integrally bent from at least one of said top and bottom walls, said front opening being substantially larger than said rear opening, said passage having a large passage portion from said front end to a transition point intermediate said front and rear ends and having a substantially smaller passage portion from said transition point to said rear end, an electrode mounted to said bottom wall intermediate said transition point and said rear end and extending upwardly therethrough, said electrode having an electrode tip spaced closely adjacent said top wall to define a spark gap therewith, said top and bottom walls being separate pieces secured together along said sidewalls, and said bottom wall having an integral mounting flange spaced therebelow for mounting said collector to a support surface with said bottom wall spaced above such support surface and with said open front end aligned with ports on a gas burner.

5. The igniter of claim 4 including an inwardly extending dimple in said top wall directly opposite said electrode tip.

* * * * *